United States Patent [19]

Goetz et al.

[11] Patent Number: 5,062,671

[45] Date of Patent: Nov. 5, 1991

[54] DOOR LATCH FOR A COMPUTER HOUSING

[75] Inventors: Frederick E. Goetz, Niceville; Michael S. Miller, Delray Beach, both of Fla.; Homer Shelton, Jr., Lexington, Ky.

[73] Assignee: IBM Corporation, Armonk, N.Y.

[21] Appl. No.: 609,298

[22] Filed: Nov. 5, 1990

[51] Int. Cl.[5] ..... E05C 1/08

[52] U.S. Cl. ..... 292/175; 292/DIG. 38; 292/DIG. 61; 292/DIG. 63

[58] Field of Search ..... 292/163, 175, DIG. 38, 292/DIG. 63, 337, 164, 171, 173, DIG. 61

[56] References Cited

U.S. PATENT DOCUMENTS

| | | | |
|---|---|---|---|
| 3,671,065 | 6/1972 | Bingham | 292/175 |
| 3,841,674 | 10/1974 | Bisbing et al. | 292/175 |
| 4,061,369 | 12/1977 | Palmer et al. | 292/DIG. 38 X |
| 4,320,834 | 3/1982 | Tamaki | 292/175 X |
| 4,909,551 | 3/1990 | Buchanan | 292/DIG. 38 X |

*Primary Examiner*—Richard E. Moore

*Attorney, Agent, or Firm*—Martin J. McKinley

[57] ABSTRACT

The latch (100) includes a catch (102) having a beveled edge (102A). An aperture (104) receives a downward force to release the catch from the lip (106A) of a housing (106). A stop (108) limits the downward movement of the latch. A retaining tab (110) traps the latch within the door pocket and limits the upward movement of the latch. The retaining tab includes a beveled surface (110A) to facilitate the insertion of the latch into the pocket. A cantilever spring (112) exerts an upward force on the latch when compressed. The latch, including all of its associated parts, can be plastic injection molded in a single-action mold. The door (200) includes a substantially parallelepiped pocket (202) having an opening at the top to receive the latch. The pocket includes a front aperture (202FA) in the upper, front surface (202F) of the pocket, and a rear aperture (202RA) in the lower, opposing rear surface (202R). When the latch is inserted into the pocket, the beveled retaining tab temporarily deforms the rear surface (202R) of the pocket and then snaps into place. When assembled, the latch aperture (104) is positioned in the front aperture (202FA) of the pocket, while the retaining tab (110) is positioned in the rear aperture (202RA) of the pocket. When closing the door, the beveled edge (102A) of the catch contacts the outer surface of the housing (106) and forces the latch down.

8 Claims, 3 Drawing Sheets

DOOR LATCH FOR A COMPUTER HOUSING

BACKGROUND OF THE INVENTION

This invention pertains to door latches and, more particularly, to an inexpensive, ultra thin, plastic injection molded door latch for a portable personal computer housing.

Computer housings typically include openings or recesses into which connectors or switches are located. For aesthetic reasons, as well as for environmental reasons, it is often desirable to cover these openings or recesses with a door that includes a latch mechanism to retain the door in the closed position.

In portable computer housings, it is desirable that this door and latch assembly be light weight, extremely thin and inexpensive to manufacture. To reduce the cost of manufacture, it is preferable that the assembly be entirely manufactured by plastic injection molding, and that the parts be moldable with, either single-action molds, or, worst case, minimal inserts in the molds. Accordingly, the invention described below is a door latch assembly that is light weight, low cost, ultra thin, and inexpensive to manufacture.

SUMMARY OF THE INVENTION

Briefly, the invention is a door latch assembly that includes a door and latch pocket integrally molded from a first mold. Also included is a slidable latch that is positioned in the pocket of the door. The latch includes a catch, a means for receiving a force for sliding the latch in a first direction, and a spring for applying a force to the latch in a second direction opposite the first direction. The latch also includes a means for retaining the latch in the door pocket and for limiting the travel of the latch in the second direction. All the component parts of the latch are integrally molded from a second mold.

In another embodiment, the invention is a computer that includes a housing enclosing a plurality of computer components. The computer housing has an opening for receiving a door. The computer includes a door and latch pocket assembly integrally molded from a first mold. The computer also includes a slidable latch, which is positioned in the door pocket. The latch includes means for receiving a force for sliding the latch in a first direction, and means for retaining the latch in the pocket and for limiting the travel of the latch in a second direction opposite the first direction. The latch also includes a catch for catching the housing when the latch is fully extended in the second direction, and a spring for applying a force to the latch in the second direction. All the component parts of the latch are integrally molded from a second mold.

In yet another embodiment, the invention is a door latch assembly that includes a plastic injection molded door and a slidable, plastic injection molded latch, which is positioned in a pocket on the door. The door includes hinge means for pivotally attaching the door to a housing and a pocket for receiving a slidable latch. The door also includes a first aperture in a first surface of the pocket, and a second aperture in a second surface of the pocket, the second surface opposing the first surface. All the component parts of the door are integrally molded from a first mold. The latch includes a catch, wherein one surface of the catch is beveled, and an aperture for receiving a force applied to the latch for sliding the latch in a first direction. The latch aperture is accessible through the first aperture in the pocket. The latch also includes a retaining tab for retaining the latch in the door pocket and for limiting the travel of the latch in a second direction. The retaining tab is positioned in the second aperture of the pocket and it includes a beveled surface to facilitate the insertion of the latch into the pocket. The latch further includes a stop for limiting the travel of the latch in the first direction, and a cantilever spring for applying a force to the latch in the second direction. All the component parts of the latch are integrally molded from a second mold, the second mold being a single-action mold.

DESCRIPTION OF THE PREFERRED EMBODIMENT

Figure 1:
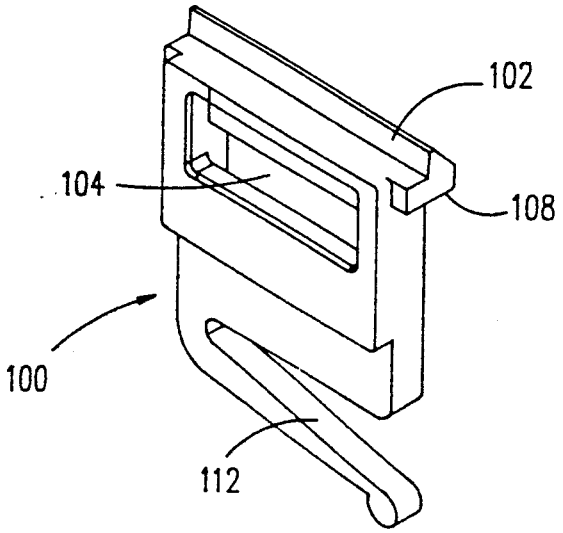
FIG. 1 is a front, right side and top perspective view of the door latch.
Figure 2:
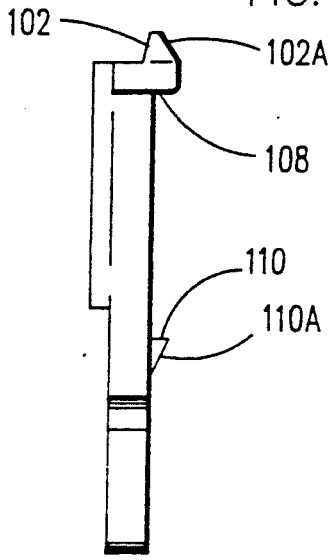
FIG. 2 is a right side elevation view of the door latch.
Figure 3:
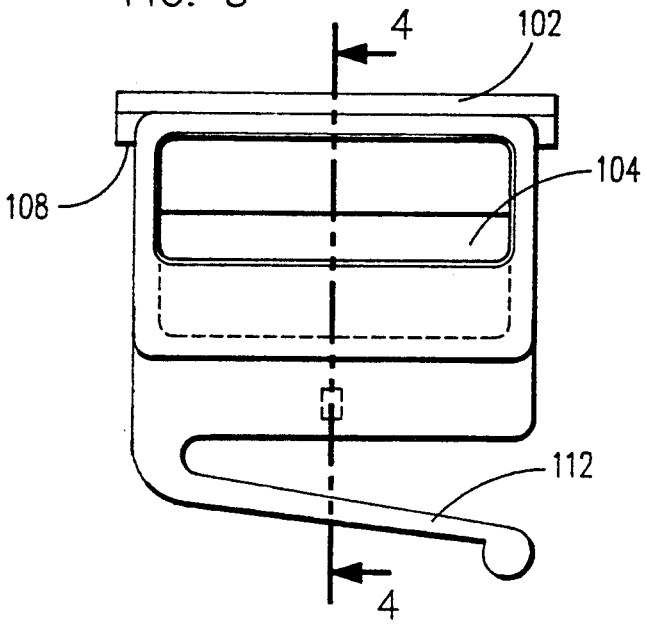
FIG. 3 is a front elevation view of the door latch.

The door latch 100 is illustrated in FIGS. 1–5. Referring to these figures, the latch includes a catch 102, which includes a beveled surface 102A. An aperture 104 provides a means for receiving a force, for example, a downward force applied by a finger, to disengage the catch 102 from the lip 106A of a housing 106. Preferably, housing 106 is a computer housing that encloses a plurality of computer components. Although an aperture is the preferred force receiving means, other structures are also possible, such as a protuberance. A lip 108, which is located below the beveled surface 102A of the catch, provides a "stop" to limit the downward movement of the latch (the operation of the stop is described below). A retaining tab 110 includes a beveled surface 110A. A cantilever spring 112, which applies an upward force on the latch when compressed, is located at the bottom of the latch. The latch 100 is made from injection molded plastic. The latch, including all of its associated parts, can be integrally molded from one single-action mold.

The door 200 is illustrated in FIGS. 6–10. Referring to these figures, the door has a front surface 200F and a rear surface 200R. The door includes a latch pocket 202, which is substantially rectangular parallelepiped in shape, but open at the top to receive the latch 100 during assembly. The pocket 202 includes a front surface 202F, a rear surface 202R opposing the front surface, and three shallow sides 202S1–S3 joining the front and rear pocket surfaces. A front aperture 202FA is located in the upper portion of the front surface 202F of the pocket, and a rear aperture 202RA is located in the lower portion of the rear surface 202R of the pocket. A pair of bosses 204 each include a hinge pin hole 204A. Hinge pins (non-illustrated) on the housing 106 mate with the hinge pin holes 204A of the door 200 to provide a means for pivotally attaching the door to the housing. The door covers an opening in the housing (located below lip 106A) and can provide access to connectors and switches positioned in the opening behind the door. Like the latch 100, the door 200 is also made from injection molded plastic and all of its associated parts, including the pocket, can be integrally molded from one mold. Because of the hinge pin holes 204A, the door mold can not be single-action. However, the mold inserts required to form the hinge pin holes have minimal travel and do not seriously impact the complexity of that mold.

Figure 4:
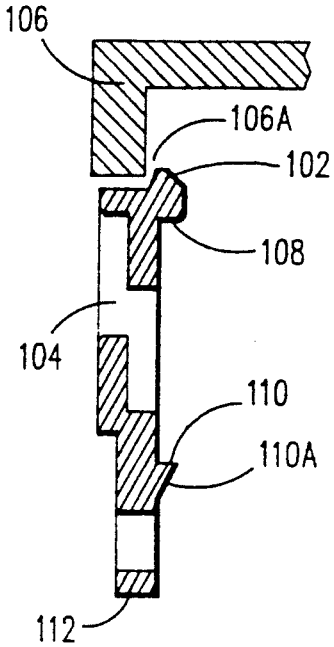
FIG. 4 is a cross sectional view of the door latch as seen along line 4—4 of FIG. 3, and further illustrating a section of the computer housing.
Figure 5:
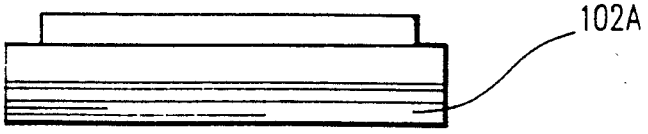
FIG. 5 top plan view of the door latch.
Figure 6:
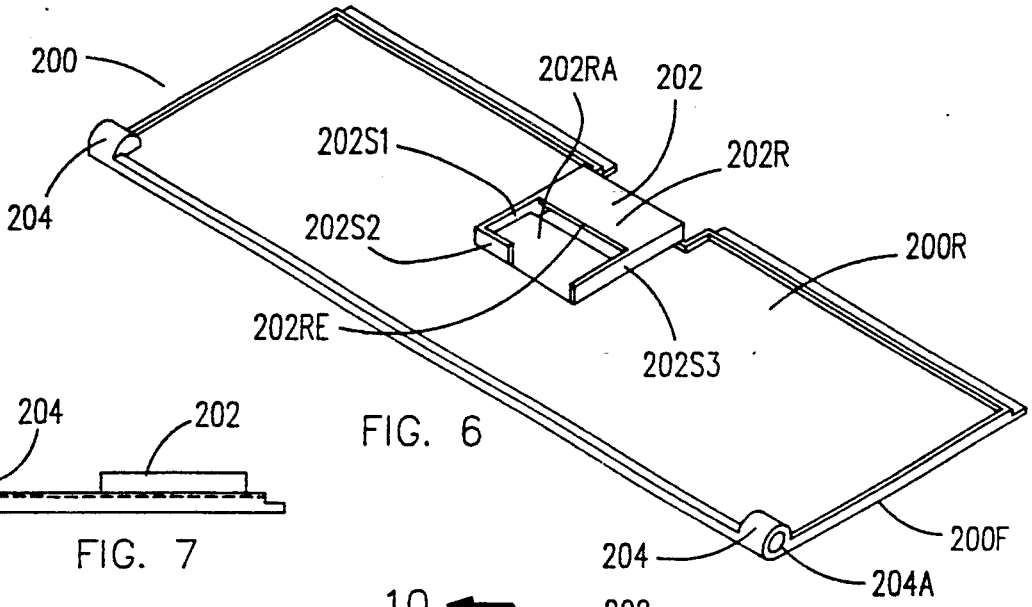
FIG. 6 is a perspective view of the door, primarily illustrating the rear surface of the door and including the pocket that retains the latch.
Figure 7:
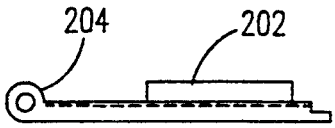
FIG. 7 is a left side view of the door.
Figure 8:
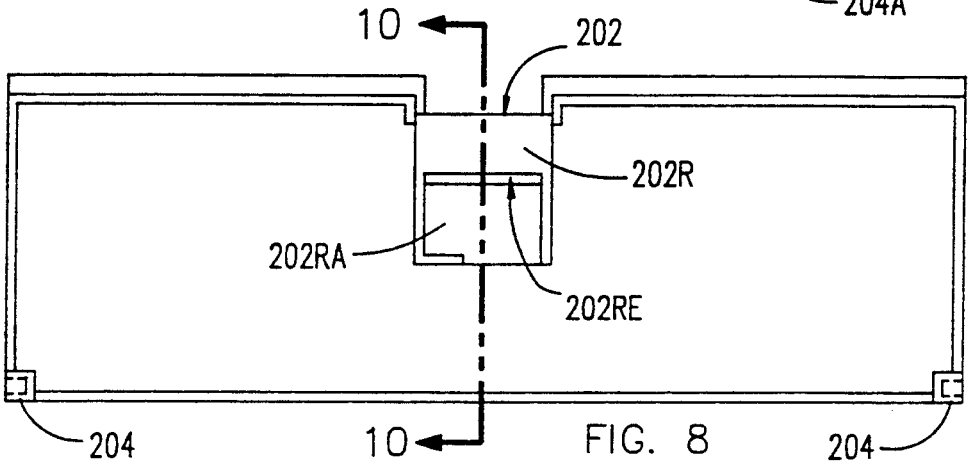
FIG. 8 is a rear elevation view of the door.
Figure 9:
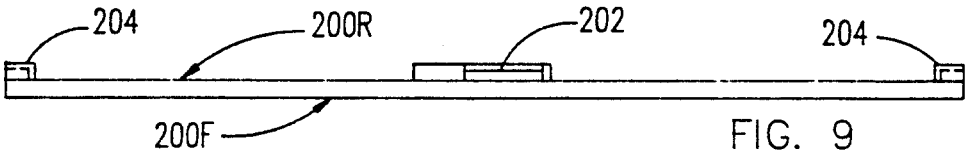
FIG. 9 is a top plan view of the door.
Figure 10:
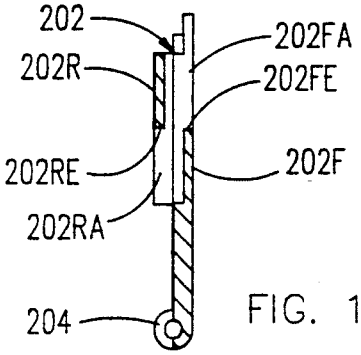
FIG. 10 is a cross sectional view of the door as seen along line 10—10 of FIG. 8.
Figure 11:
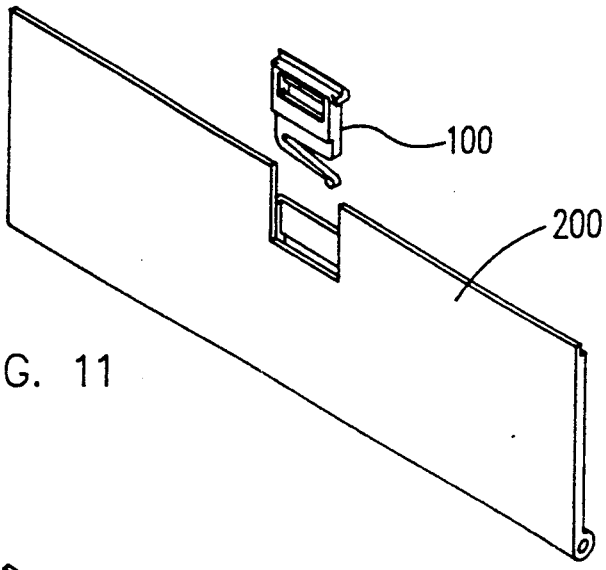
FIG. 11 is a exploded perspective view of the door latch assembly, primarily illustrating the front surface of the door and latch.
Figure 12:
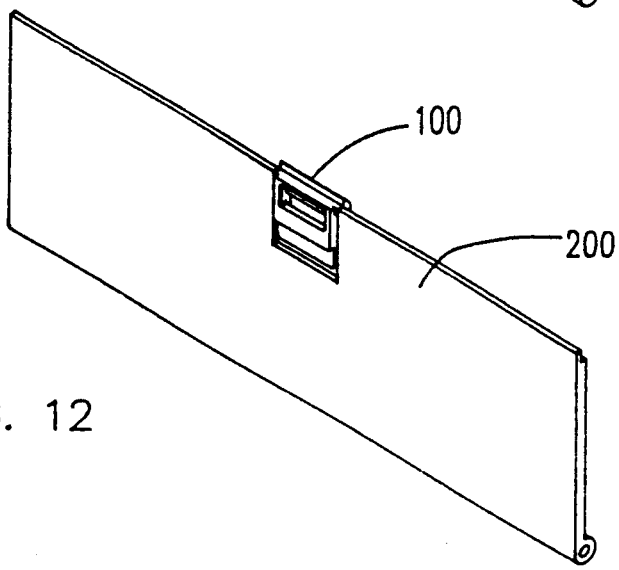
FIG. 12 is a perspective view of the door with the latch assembled into the pocket, primarily illustrating the front surface of the door.
Figure 13:
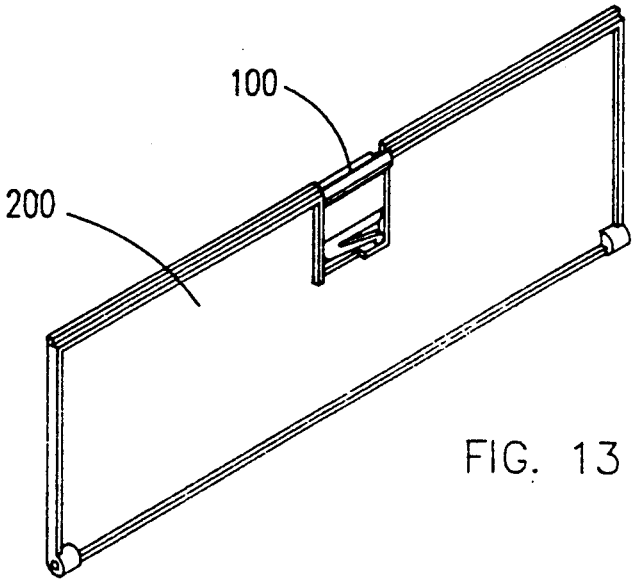
FIG. 13 is a perspective view of the door with the latch assembled into the pocket, primarily illustrating the rear surface of the door.

The complete door latch assembly is illustrated in FIGS. 11–13. Referring to these figures, the latch 100 is inserted into the pocket 202 such that the beveled surface 110A of the retaining tab 110 temporarily deforms the rear surface 202R of the pocket and, once the tab clears the lower edge 202RE of the rear surface 202R of the pocket, the latch snaps into place where it is permanently retained in the pocket. If the latch 100 is forced downward by the application of pressure to the latch aperture 104, the stop 108 eventually strikes the upper edge 202FE of the front surface 202F of the pocket, thereby limiting the downward movement of the latch. When the spring 112 is compressed, the latch is forced upward until it either engages the housing 106, as illustrated in FIG. 4, or the retaining tab 110 engages the edge 202RE of the rear surface 202R of the pocket, thereby limiting the upward movement of the latch and preventing the tab from being removed from the pocket.

We claim as our invention:

1. A door latch assembly, comprising in combination:

a door including a latch pocket, said latch pocket includes a first aperture in a first surface of said pocket, and a second aperture in a second surface of said pocket, said second surface opposing said first surface;

a slidable latch positioned in said pocket of said door, said latch including the following parts: a catch; means for receiving a force for sliding said latch in a first direction, said force receiving means is positioned in said first aperture of said pocket; means for retaining said latch in said pocket and for limiting the travel of said latch in a second direction opposite said first direction, said means for retaining is positioned in said second aperture of said pocket; and a spring for applying a force to said latch in said second direction.

2. The door latch assembly of claim 1, wherein said spring is a cantilever spring.

3. The door latch assembly of claim 1, wherein said means for retaining said latch in said pocket includes a retaining tab, said retaining tab including a beveled surface to facilitate the insertion of said latch into said pocket.

4. The door latch assembly of claim 1, wherein said force receiving means includes an aperture in said latch.

5. A computer, comprising in combination:

a computer housing enclosing a plurality of computer components, said computer housing having an opening for receiving a door;

a door and latch pocket, said latch pocket includes a first aperture in a first surface of said pocket, and a second aperture in a second surface of said pocket, said second surface opposing said first surface;

a slidable latch positioned in said pocket of said door, said latch including the following parts: means for receiving a force for sliding said latch in a first direction, said force receiving means is positioned in said first aperture of said pocket; means for retaining said latch in said pocket and for limiting the travel of said latch in a second direction opposite said first direction, said means for retaining is positioned in said second aperture of said pocket; a catch for catching said housing when said latch is fully extended in said second direction; and a spring for applying a force to said latch in said second direction.

6. The door latch assembly of claim 5, wherein said spring is a cantilever spring.

7. The door latch assembly of claim 5, wherein said means for retaining said latch in said pocket includes a retaining tab, said retaining tab including a beveled surface to facilitate the insertion of said latch into said pocket.

8. A door latch assembly, comprising in combination:

a plastic injection-molded door including the following parts: hinge means for pivotally attaching said door to a housing; a pocket for receiving a slidable latch; a first aperture in a first surface of said pocket; and a second aperture in a second surface of said pocket, said second surface opposing said first surface; and a slidable, plastic injection-molded latch positioned in said pocket of said door, said latch including the following parts: a catch, one surface of said catch being beveled; an aperture for receiving a force applied to said latch to slide said latch in a first direction, said aperture in said latch being accessible through said first aperture in said pocket; a retaining tab for retaining said latch in said door pocket and for limiting the travel of said latch in a second direction, said retaining tab being positioned in said second aperture of said pocket, said retaining tab including a beveled surface to facilitate the insertion of said latch into said pocket; a stop for limiting the travel of said latch in said first direction; and a cantilever spring for applying a force to said latch in said second direction.

* * * * *